US005131042A

United States Patent [19]

Oda

[11] Patent Number: 5,131,042

[45] Date of Patent: Jul. 14, 1992

[54] MUSIC TONE PITCH SHIFT APPARATUS

[75] Inventor: Mikio Oda, Yawata, Japan

[73] Assignee: Matsushita Electric Industrial Co., Ltd., Osaka, Japan

[21] Appl. No.: 496,640

[22] Filed: Mar. 21, 1990

[30] Foreign Application Priority Data

Mar. 27, 1989 [JP] Japan ..... 1-74589

[51] Int. Cl.[5] ..... G10L 7/02

[52] U.S. Cl. ..... 381/34; 84/605

[58] Field of Search ..... 381/29–41, 381/51–53; 364/513.5; 84/605, 648

[56] References Cited

U.S. PATENT DOCUMENTS

| | | | |
|---|---|---|---|
| 4,464,784 | 8/1984 | Agnello | 381/34 |
| 4,586,191 | 4/1986 | Nishimura | 381/34 |
| 4,627,090 | 12/1986 | Smith et al. | 381/34 |
| 4,700,391 | 10/1987 | Leslie et al. | 381/35 |
| 4,792,975 | 12/1988 | Mackay | 381/34 |

*Primary Examiner*—Emanuel S. Kemeny
*Assistant Examiner*—John A. Merecki
*Attorney, Agent, or Firm*—Stevens, Davis, Miller & Mosher

[57] ABSTRACT

A music tone pitch shift apparatus which converts an original audio signal into digital data by way of pulse code modulation (PCM), shifting the pitch, and converting the pitch shifted digital data into an analog signal. The PCM digital data is stored in a ring memory at a given sampling speed, and is read out of the memory by a pair of identical read circuits at a common read addressing speed corresponding to the desired pitch. One of the read circuits starts reading from the opposite address location to the other on the ring memory. Since the read addressing speed is set faster than the write addressing speed when increasing the pitch, and vice versa, overtaking or lapping between the addresses could occur. In switching alternately the read circuits from a now-outputting side to a switching-to side, the read address on the switching-to side circuit is stopped increasing at an address location where a zero-amplitude data has been read, until a zero-amplitude data in phase with that which the switching-to side circuit has read is read by the now-outputting side circuit and the switching is made, immediately before the overtaking or lapping occurs on the now-outputting side circuit. Thus, a smooth connection of the pitch shifted audio signals can be made without including such amplitude modulated components as in the cross fade method, and therefore, a high-quality music tone pitch shift operation can be realized.

4 Claims, 5 Drawing Sheets

MUSIC TONE PITCH SHIFT APPARATUS

BACKGROUND OF THE INVENTION

This invention relates to a music tone pitch shift apparatus (hereinafter referred to as a "pitch shift apparatus") and particularly to one in which analog audio signals are converted into pulse code modulation (PCM) digital data and then pitch shifted.

Recently, audio signal processing techniques have undergone rapid development, and digital signal processing techniques have been developed to achieve high performance and high precision.

The pitch shift apparatus has been improved in its performance and precision by the use of the digital processing technique as the electronic musical instruments or electronic accompanist machines for vocalists (KARAOKE) have been widely used and developed. The conventional pitch shift apparatus has used an adaptive delta modulation (ADM) system as an analog to digital (A/D) conversion technique for converting analog signals into digital signals in order to reduce circuit scale and cost, and made the pitch shift process and D/A (digital/analog) conversion on the ADM digital, data to thereby produce analog audio signals (see The Journal of Institute of Electronics and Communication Engineers of Japan, EA85-40, issued 1985, 9.26).

In this conventional ADM system pitch shift apparatus, however, satisfactory performance could not be achieved. In recent years, the ADM system has almost been replaced by pulse code modulation (PCM) as the A/D conversion technique, because the signal to noise ratio (S/N) distortion, and linearity in the A/D conversion of the PCM system have been greatly improved with the development of the digital technology.

One example of the conventional PCM system pitch shift apparatus will hereinafter be described.

FIG. 3 is a block diagram of a conventional pitch shift apparatus, and FIG. 4 is an explanatory diagram for the explanation of the basic principle of the pitch shift operation, FIG. 5 is a schematic diagram useful for explaining the addresses of a ring memory in and from which writing and reading are made, and FIG. 6 is a diagram showing waveforms at the various portions of the pitch shift apparatus of FIG. 3.

Referring to FIG. 3, there are shown an A/D converter 1, a memory 2, a memory write address generator circuit (WR1 ADD) 3, a first memory read address generator circuit (RD1 ADD) 4, a second memory read address generator circuit (RD2 ADD) 5, D/A converters 9, 18, attenuators 19, 20, and an adder 21. The operation of the pitch shift apparatus will be described with reference to the drawings.

As illustrated in FIG. 3, an analog audio signal is supplied via an input terminal to the A/D converter 1, where it is sampled at a sampling frequency fs and converted into a PCM digital signal. This PCM digital signal is sequentially written in the memory 2 at the addresses specified by the memory write address generator circuit 3. The memory 2 is formed of a RAM (random access memory) as a ring memory. As shown in FIG. 5, the address beings at 0-address, increases at the frequency fs until the maximum, and again begins at 0-address.

The first memory read address generator circuit 4 is constructed to increase the address at intervals different from those of the memory write address generator circuit 3. The timing (intervals of time) for the reading is made as follows. For example, to increase the pitch, the intervals of time are made shorter than 1/fs [sec] (write timing (interval of time)), and to decrease the pitch, the intervals of time are made longer than 1/fs [sec]. FIG. 4 shows the change of the audio signal waveform for the decrease of the pitch. From FIG. 4 it will be understood that the read timing T2 is longer than the write timing T1 (1/fs), or that the pitch-shifted waveform (b) of FIG. 4 has a frequency lower than that of the original waveform (a) of FIG. 4, or that the pitch is reduced.

The second memory read address generator circuit 5 is constructed to generate the address which is spaced by an amount corresponding to ½ the ring memory from the address which the first read address generator circuit 4 generates. The PCM digital data read from the address specified by the first memory address generator circuit 4 is supplied to the D/A converter 9, and the PCM digital data read from the address specified by the second memory address generator circuit 5 is fed to the D/A converter 18. The outputs from the D/A converters 9, 18 are respectively supplied through the weighting attenuators 19, 20 to the adder 21, which produces the final pitch-shifted output (analog audio signal).

In this pitch shift apparatus, however, the amplitude of the pitch-converted output is not constant (see FIG. 6*e*), or an amplitude-modulated analog audio signal is obtained, so that a sine wave input with a constant amplitude results in offensive sound. In other words, since the timing T1 of the address from the memory write address generator circuit 3 is different from that T2 of the address from the first and second memory read address generator circuit 4, 5, overtaking or lapping between the two addresses occurs with a constant period as time elapses. At this time, the PCM digital data read from the address specified by the first read address generator circuit 4 has discontinuous points (where the overtaking or lapping occurs) at, for example, ta, tb. tc, ... as shown in waveform (a) of FIG. 6 depending on the phase of the audio signal, and similarly the PCM digital data read from the address specified by the second read address generator circuit 5 which differs in read timing by ½ the ring memory has discontinuous points at intermediate points between the discontinuous points shown in waveform (a) of FIG. 6, or at ta′ between ta and tb, tb′ between tb and tc, ... as shown in waveform (b) of FIG. 6. In waveforms (a) and (b) of FIG. 6, for convenience of explanation, the digital data is shown in an analog manner. The PCM digital data at these discontinuous points cause impulse noise. Thus, to reduce this noise, the prior art used the cross-fade method. In this method, if the waveforms shown in (a) and (b) of FIG. 6 are expressed by F1(t) and F2(t), respectively, and the weighting coefficients of the attenuators 19 and 20 by $\alpha 1(t)$ and $\alpha 2(t)$, respectively, these waveform are usually weighted by the functions $\alpha 1(t)$, $\alpha 2(t)$ which have the relation, $\alpha 1(t)+\alpha 2(t)=1$ as shown by waveforms (c) and (d) of FIG. 6 so that the impulse noise can be eliminated at the discontinuous points, and that $\alpha 1(t)\cdot F1(t)+\alpha 2(t)\cdot F2(t)$ can be obtained as the final output waveform (e) of FIG. 6. In this method, however, although the impulse noise at the discontinuous points can be eliminated, the pitch shifted output waveform (the final output waveform) has an amplitude modulated (AM) component as shown by waveform (e) in FIG. 6.

SUMMARY OF THE INVENTION

Accordingly, it is an object of the invention to make it possible to smoothly connect the read addresses without occurrence of the AM component at the discontinuous points due to the overtaking or lapping delay between the addresses in the cross-fade method, by detecting the in-phase zero-cross position of audio data on the now-beginning side of the two read address generator circuits different in read timing by ½ the ring memory from each other, detecting the in-phase zero-cross position of audio data on the other now-finally generating read address generator circuit side, and controlling the read address from the switching-to-memory read address generator circuit at the connection point so that the read addresses from the address generator circuits can be connected at the in-phase zero-cross position, before the occurrence of the discontinuous points.

DESCRIPTION OF THE PREFERRED EMBODIMENT

One embodiment of this invention will be described with reference to the accompanying drawings.

Figure 1:
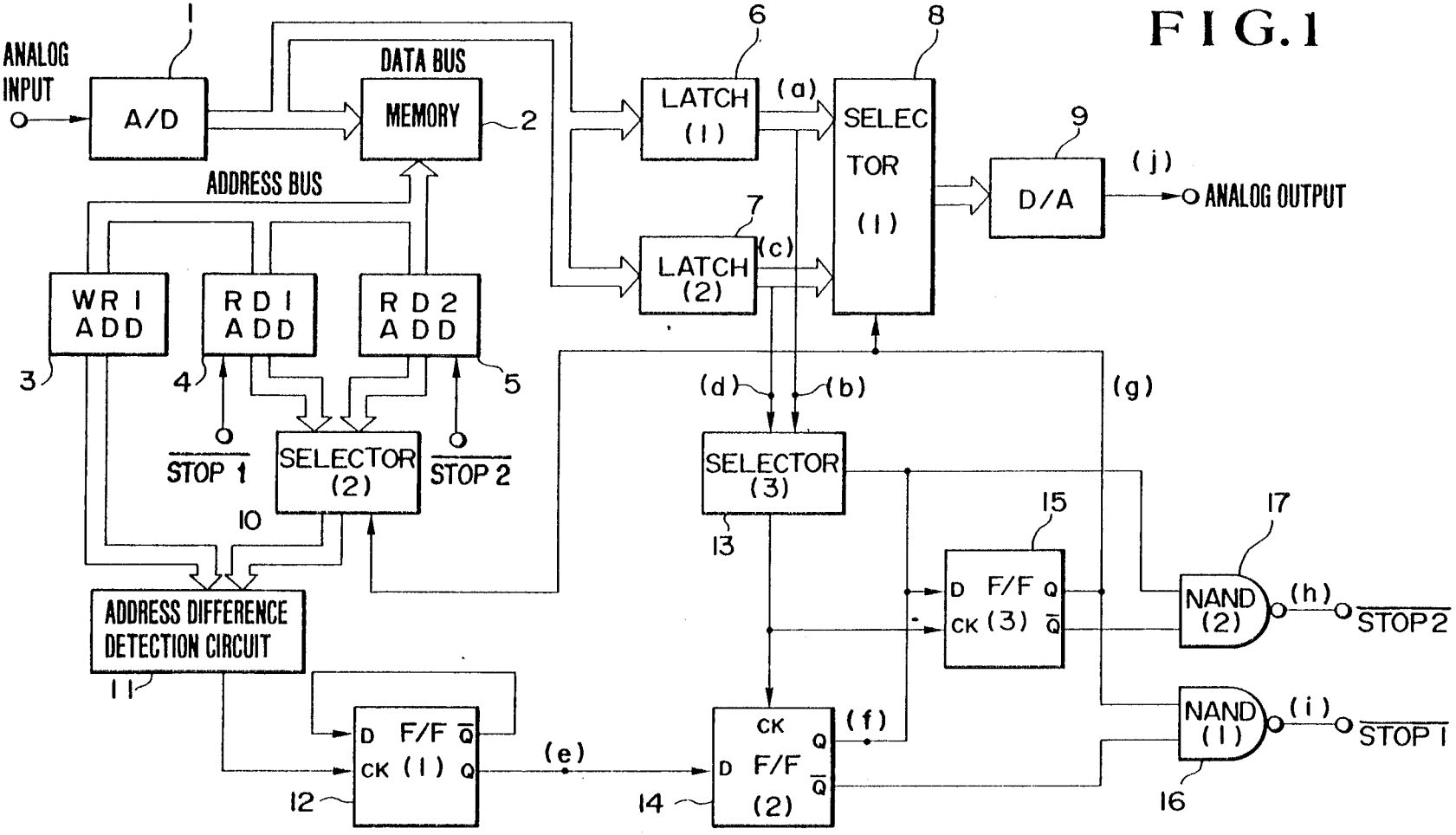
FIG. 1 is a block diagram of one embodiment of a pitch shift apparatus of this invention.

Referring to FIG. 1, there are shown an A/D converter, for converting an analog signal to a PCM digital signal (of 16 bits in this embodiment), a memory 2 formed of a random access memory (RAM) acting as a ring memory, a memory write address generator circuit 3, a first memory read address generator circuit 4, a second memory read address generator circuit 5, a first latch circuit 6 for latching data read by said first memory read address generator circuit 4, a second latch circuit 7 for latching data read by the second memory read address generator circuit 5, a first selector circuit 8 for selecting one of the data from the latch circuits 6 and 7, and a D/A converter 9 for converting the digital data from the first selector circuit 8 into an analog signal. There is also shown a second selector circuit 10 for selecting such read address from the first or second memory read address generator circuit 4, 5, that analog data corresponding to the digital data read from that address of the memory 2 is now being finally produced through the first selector 8 and D/A converter 9. In addition, shown at 11 is an address difference detection circuit which detects the difference between the address from the memory write address generator circuit 3 and the address from the first or second memory read address generator circuit 4, 5 selected by the selector circuit 10 and produces a pulse when the address difference is a predetermined value. Shown at 12 is a first flip flop F/F circuit for data inversion which is controlled by the output from the address difference detection circuit 11, and 13 is a third selector circuit for selecting the MSB (most significant bit), YD15 ((b) in FIG. 2) or ZD15 ((d) in FIG. 2) of the data which was read by the memory read address generator circuit 4 or 5 that is now going to be switched to, and stored in the latch circuit 6 or 7. Shown at 14 is a second F/F circuit which has a data input to which the output from the first F/F circuit 12 is supplied and a clock input to which the output from the third selector circuit 13 is supplied, and 15 is a third F/F circuit which has a data input to which the output from the second F/F circuit 14 and a clock input to which the output from the third selector circuit 13 is supplied. Shown at 16 is a first NAND circuit for producing the logical product of the inverted output $\overline{Q}$ of the second F/F circuit 14 and the output Q of the third F/F circuit 15, and 17 is a second NAND circuit for producing the logical product of the output Q of the second F/F circuit 14 and the inverted output $\overline{Q}$ of the third F/F circuit 15. The outputs from the first and second NAND circuits 16, 17 control the first and second memory read address generator circuits 4, 5 to increase the addresses to the memory 2, respectively.

Figure 2:
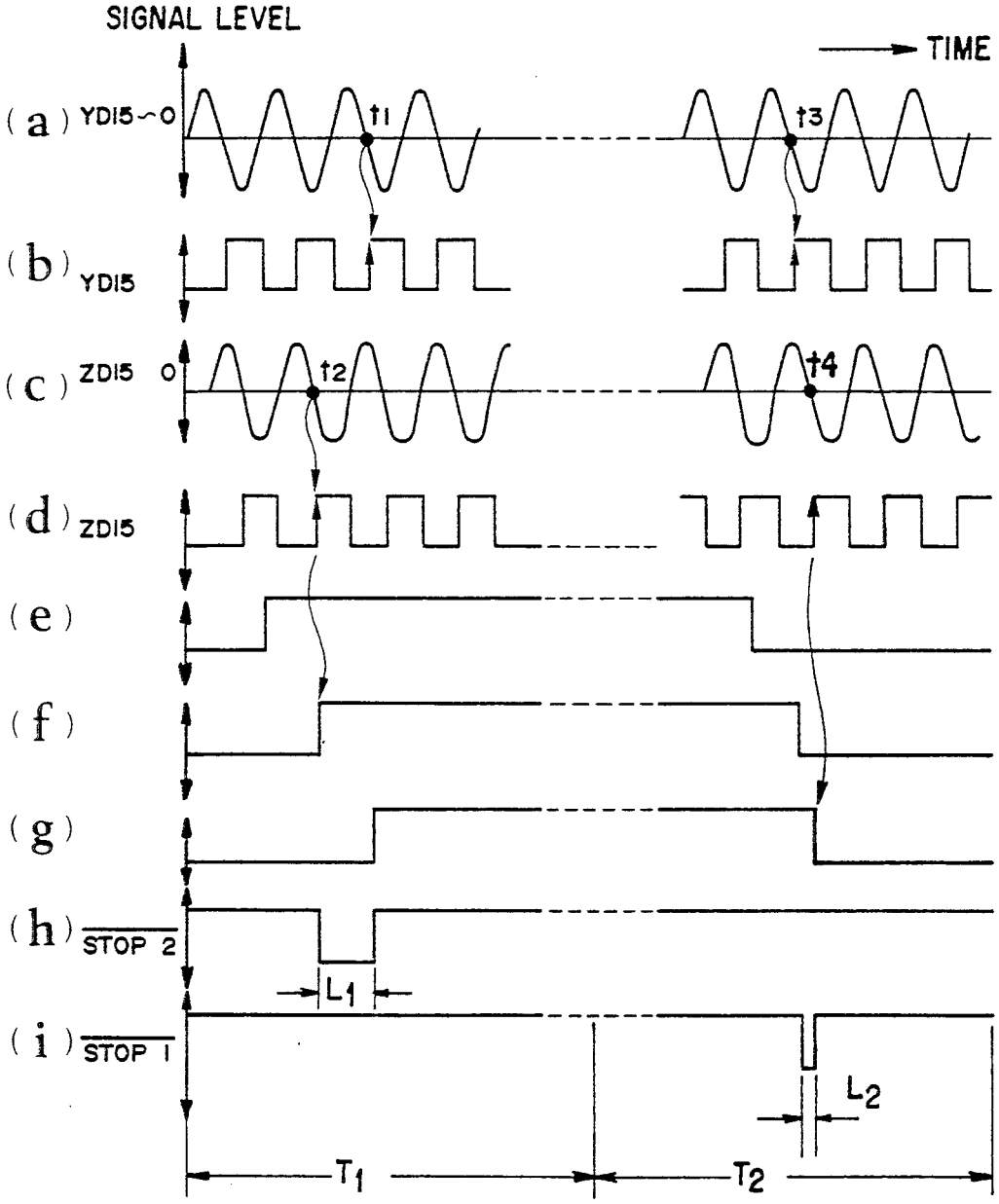
FIG. 2 is a diagram showing waveforms (a) to (e) at various portions of the embodiment of FIG. 1.
Figure 3:
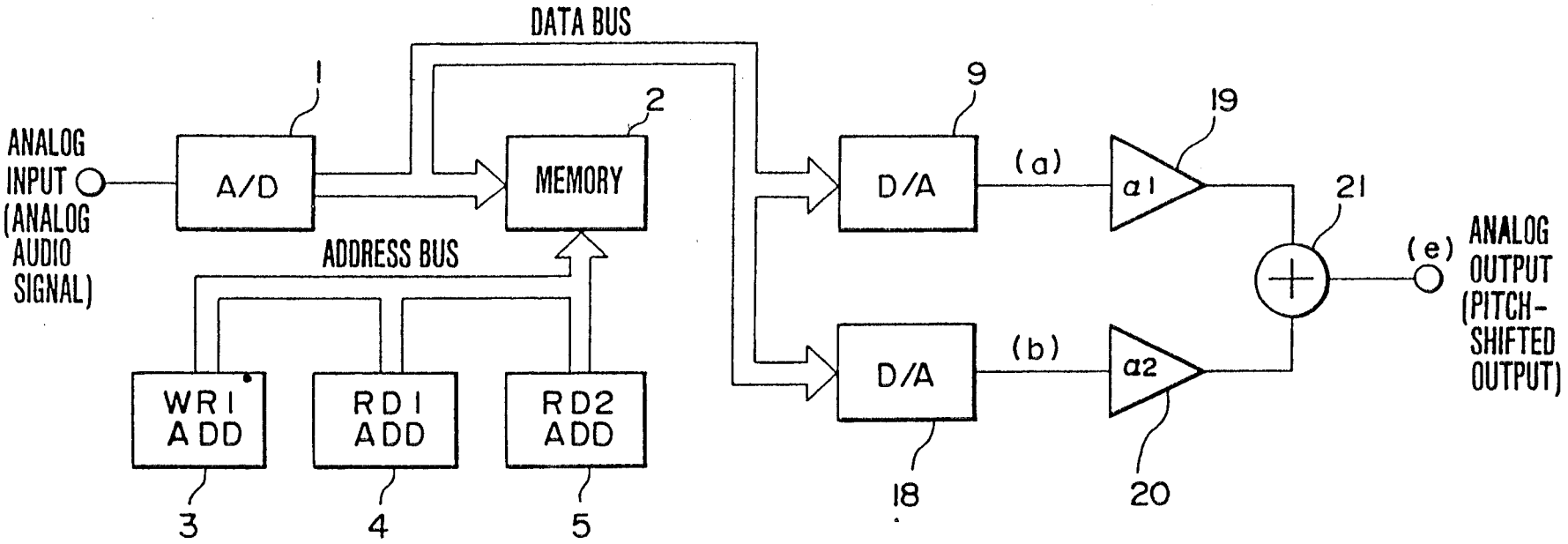
FIG.3 PRIOR ART
FIG. 3 is a block diagram of a conventional pitch shift apparatus.
Figure 4:
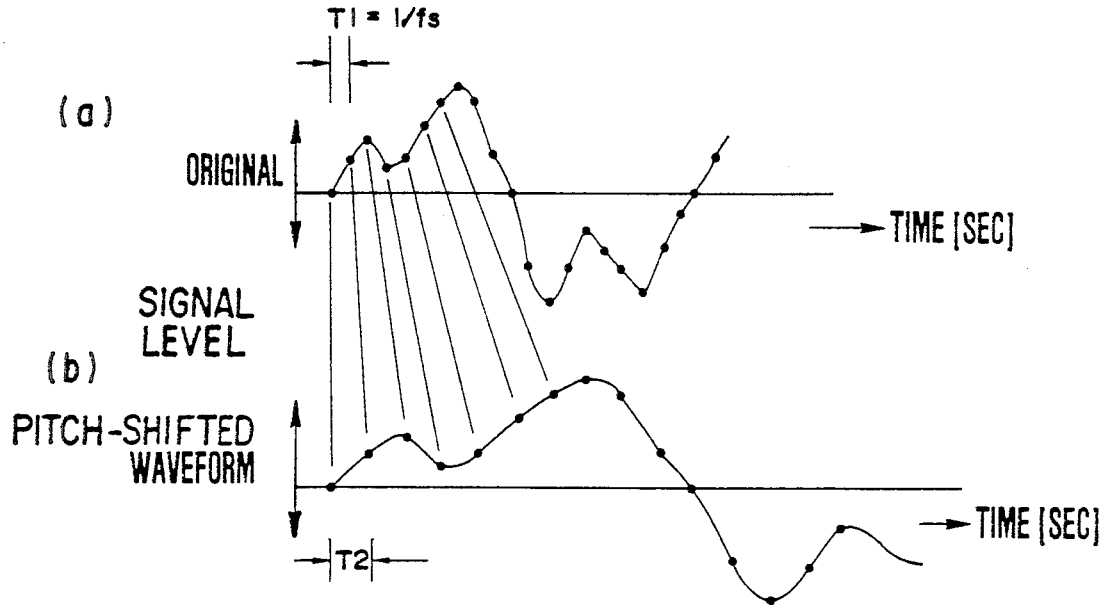
FIG. 4 is a schematic diagram showing the relationship between an original signal (a) and a pitch shifted signal (b) in the operation of the pitch shift apparatus.
Figure 5:
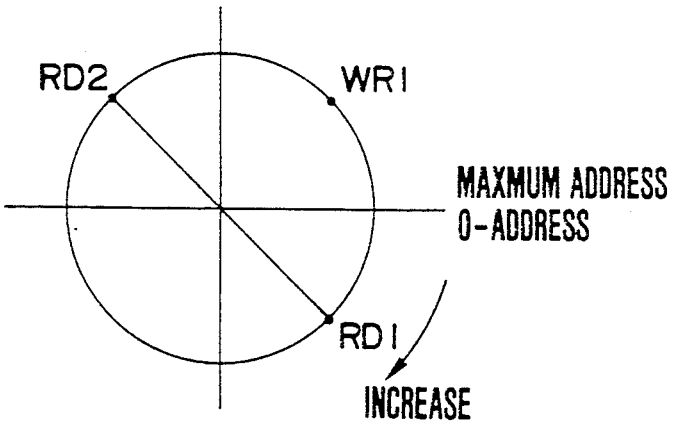
FIG. 5 is a schematic diagram useful for explaining the write address and read address to the memory.
Figure 6:
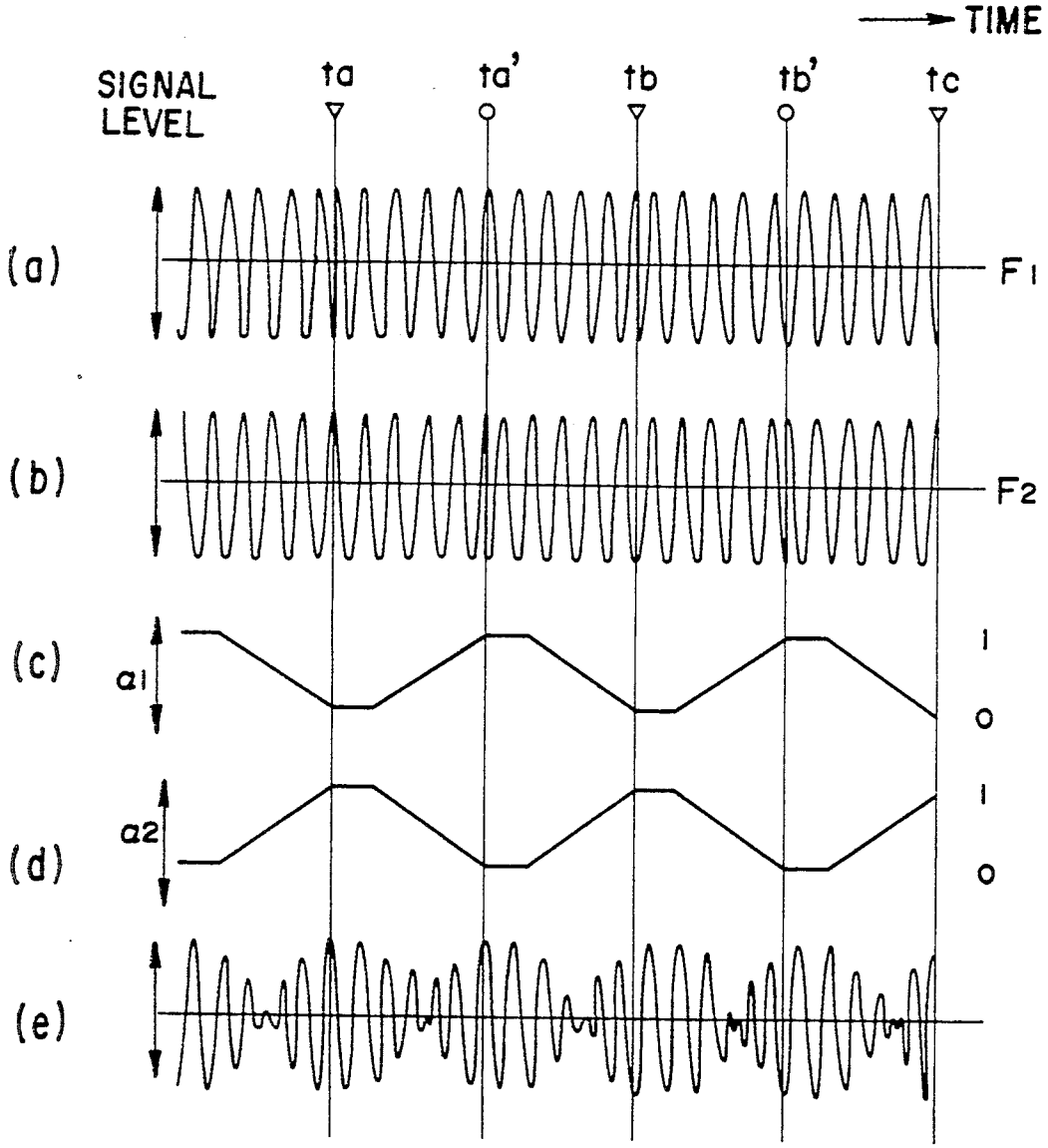
FIG.6 PRIOR ART
FIG. 6 is a diagram showing waveforms (a) to (i) at various portions of the conventional pitch shift apparatus shown in FIG. 3.

FIG. 2 is a diagram showing waveforms at the various portions of the pitch shift apparatus shown in FIG. 1. The analog waveforms shown in FIG. 2 at (a) and (c) for convenience of explanation are actually digital data.

The operation of the pitch shift apparatus of this embodiment will be described with reference to FIGS. 1 and 2.

As mentioned above, if the digital data read by the first and second memory read address generator circuits 4, 5 and then read from the first and second latch circuits 6, 7 are converted into analog signals, the waveforms of the analog signals are as shown in FIG. 2 at (a), (c), respectively. At this time, the MSB data of the digital data which are tentatively shown in the analog waveforms in FIG. 2 at (a), (c) are offset binary codes, and thus pulses having H level in negative halves and L level in positive halves as indicated at (b), (d) in FIG. 2.

First, since the Q-output of the first F/F circuit 12 cleared by resetting is level L, and the selected signal from the third selector 13 is the first signal pulse, though the leading edge is indefinite, the Q-output of the second F/F circuit 14 becomes level L. The third selector 13 selects the MSB, ZD15 (FIG. 2 at (d)) of the output data ZD15 Q of the second latch circuit 7.

When the pitch shift operation is repeated to enter in the region (for example, when the difference between the read address and write address becomes ¼ the ring memory) in which the cyclic delay may easily to occur, the address detection circuit 11 supplies a clock pulse to the first F/F circuit 12, causing its output (e) high level H. At this time, the output of the second F/F circuit 14, as shown in FIG. 2 at (f) is low level L, and the MSB (FIG. 2 at (d)) of the output of the second latch circuit 7 is passed through the third selector circuit 13. After the output of the first F/F circuit 12 (FIG. 2, at (e)) becomes high level H, the output of the second F/F circuit 14 (FIG. 2 at (f)) becomes high at the first leading edge of the pulse (FIG. 2 at (d)). Then, the MSB, YD15 (FIG. 2 at (b)) of the output data YD15 Q of the first latch circuit 6 is produced. Moreover, after the output of the second F/F circuit 14 (FIG. 2 at (f)) becomes high level H, the output of the third F/F circuit 15 (FIG. 2 at (g)) becomes high level at the first leading edge of the pulse (FIG. 2 at (b)), and the first selector 8 produces the output data (FIG. 2 at (c)) of the second latch circuit 7 in place of the output of the first latch circuit (FIG. 2 at (a)). At this time, switching is made from the first read address generator circuit 4 to the second read address generator circuit 5. The Q-output of the second F/F circuit 14 (FIG. 2 at (f)) and the Q-output of the third F/F circuit 15, or the inversion of the output shown in FIG. 2 at (g) are supplied to the NAND circuit 17, which then produces a STOP 2 signal.

In other words, in the time difference (difference between the leading edges of pulses) between the output of the second F/F circuit 14 (FIG. 2 at (f)) and the output of the third F/F circuit 15 (FIG. 2 at (g)), or in the interval from time t2 when the digital audio signal to be read by the second read address generator circuit 5 which is going to make read operation makes zero crossing to time t1 when the digital audio signal which is now being read by the first read address generator circuit 4 which is making read operation makes in-phase zero crossing, the second read address generator circuit 5 is stopped from increasing the address. Then, from the time when switching is made from the first read address generator circuit 4 to the second read address generator circuit 5, the second read address generator circuit 5 again starts to increase the address. Thus, at time point t1, the digital audio signals can be connected in phase upon switching from the first address generator circuit 4 to the second address generator circuit 5.

When the second address generator circuit 5 repeats the pitch shift operation to enter in the region (for example, the difference between the read address and the write address is ¼ the ring memory) in which a cyclic delay to the write address generator circuit 3 is easy to occur, the clock pulse from the address difference circuit 11 is supplied to the first F/F circuit 12, so that the Q-output of the first F/F circuit 12 (FIG. 2 at (e)) is inverted to be low level L. At this time, the MSB of the output of the first latch circuit 6 (FIG. 2 at (b)) is supplied through the third selector circuit 13. When the Q-output of the first F/F circuit 12 is low level L, the output of the second F/F circuit 14 (FIG. 2 at (f)) becomes low level L at the first leading edge of the pulse (FIG. 2 at (b)), and the MSB of the output of the second latch circuit 7 (FIG. 2 at (d)) is produced. Moreover, when the output of the second F/F circuit 14 (FIG. 2 at (f)) becomes low level L, the Q-output of the third F/F circuit 15 (FIG. 2 at (g)) becomes low level L at the first leading edge of the pulse (FIG. 2 at (d)). The first selector circuit 8 produces output data of the first latch circuit 6 (FIG. 2 at (a)) in addition to the output of the second latch circuit 7 (FIG. 2 at (c)). Then, the Q-output of the third F/F circuit 15 (FIG. 2 at (g)) and the $\overline{Q}$-output of the second F/F circuit 14, or the inversion of the output shown in FIG. 2 at (f) are supplied to the first NAND circuit 16 which then produces a STOP 1 signal. Thus, the first read address generator circuit 4 is stopped from increasing the address during the delay time between the output of the second F/F circuit 14 (FIG. 2 at (f)) and the output of the third F/F circuit 15 (FIG. 2 at (g)) (the difference between the trailing edges of the pulses). In other words, during the interval from time point t3 when the digital audio signal to be read by the first read address generator circuit 4 which is going to make read operation makes zero crossing to time point t4 when the digital audio signal which is now being read (by the second read address generator circuit 5) makes in-phase zero crossing, the first read address generator circuit 4 is stopped from increasing the address. Then, at the time when switching is made from the second read address generator circuit 5 to the first read address generator circuit 4, the first read address generator circuit 4 is again started to increase the address, thereby enabling the digital audio signals to be connected at time point t4 in phase upon switching from the second read address generator circuit 5 to the first read address generator circuit 4.

While, in this embodiment, connection is made, or switching is made, at the zero-cross point where the data is changed from positive to negative phase, the switching may of course be made at the zero-cross point where data is changed from negative to positive phase.

Thus, according to this invention, the two read address generator circuits are controlled at the connection in order that the read addresses can be connected at the in-phase zero-cross point of the audio data, thereby avoiding at the connection the generation of the AM modulated components which appear in the cross fade method due to the passing between the addresses or cyclic delay that is caused by the difference between the interval of time during which the audio data is written in the memory and the interval of time during which it is read therefrom. This follows that smooth connection of audio data can be made by only the addition of a simple control circuit for the read address generation circuits without any complicated cross fade circuit, and with the use of only one D/A converter, resulting in great reduction of cost.

I claim:

1. A pitch shift apparatus comprising:

an analog to digital (A/D) converter for converting an analog audio signal to a pulse code modulated (PCM) digital data;

a memory receiving said PCM digital data from said A/D converter so that said PCM digital data are written in and read from said memory;

a write address generator circuit for setting a write address to said memory;

a first memory read address generator circuit for generating a read address with respect to said memory and for permitting said PCM digital data written in said memory to be read at a predetermined pitch;

a second memory read address generator circuit which is provided in parallel with said first memory read address generator and which starts its reading operation by generating an address that differs by an equivalent for a ½ ring memory from the address which said first memory read address generator circuit generates;

first and second latch circuits connected in parallel for latching data read from said memory by said first and second read address generator circuits;

a first selector for selectively providing an output comprising one of (i) output data from said first latch circuit and (ii) output data from said second latch circuit;

a digital to analog (D/A) converter receiving said output from said first selector so as to convert said digital data into an analog signal;

a second selector for selectively providing final output data comprising the read address which one of said first and second memory read address generator circuits is now generating;

an address difference detecting circuit for detecting a difference between the read address from said second selector and a write address and providing an output pulse when said difference has a given value;

a first flip flop (F/F) circuit provided in series with said address difference detecting circuit and controlled such that its output is inverted by receipt of said output pulse of said address difference detecting circuit;

a third selector circuit for selecting the most significant bit of the output data from said first or second latch circuit which is associated with the data to which switching is to be made;

a second F/F circuit having a clock input to which the output of said third selector circuit is supplied, and a data input to which the output of said first F/F circuit is supplied;

a third F/F circuit having a data input to which the output of said second F/F circuit is supplied, and a clock input to which the output of said third selector circuit is supplied, the output of said third F/F circuit being supplied as a switching signal to said first and second selector circuits;

a first NAND circuit for producing an output representing the logical product of the inverted output of said second F/F circuit and the output of said third F/F circuit to said first read address generator circuit to increase the address generated thereby; and a second NAND circuit for producing an output representing the logical product of the inverted output of said third F/F circuit and the output of said second F/F circuit to said second read address generator circuit to increase the address generated thereby.

2. A pitch shift apparatus comprising:

an analog to digital (A/D) converter for converting an analog audio signal to digital data;

a memory for storing said digital data from said A/D converter;

a write address generator circuit for setting a write address to said memory;

a first memory read address generator circuit for generating a read address with respect to said memory and for permitting said digital data written in said memory to be read at a predetermined pitch;

a second memory read address generator circuit which starts its reading operation by generating an address that differs from the address which said first memory read address generator circuit generates;

a first latch circuit for latching data read from said memory by said first read address generator circuit;

a second latch circuit for latching data read from said memory by said second read address generator;

a first selector circuit for selectively providing an output comprising (i) one of output data from said first latch circuit and (ii) output data from said second latch circuit;

a digital to analog (D/A) converter for converting digital data from said first selector circuit into an analog signal;

a second selector circuit for selectively providing an output comprising the read address which is generated from said first or second read address generator circuit and used so that the digital data selected by and produced from said first selector is now being read;

an address difference detecting circuit for detecting the difference between the read address from said second selector circuit and a write address from said write address generator circuit and producing a pulse when said difference becomes a predetermined value;

a first flip flop (F/F) circuit having an output which is inverted by said pulse from said address difference detecting circuit;

a third selector circuit for selecting the most significant bit of the output digital data from said first or second latch circuit which is associated with the data to which switching is to be made;

a second F/F circuit having a clock input to which the output of said third selector circuit is supplied, and a data input to which the output of said first F/F circuit is supplied;

a third F/F circuit having a data input to which the output of said second F/F circuit is supplied, and a clock input to which the output of said third selector circuit is supplied;

a first NAND circuit for producing an output representing the logical product of the inverted output of said second F/F circuit and the output of said third F/F circuit; and a second NAND circuit for producing an output representing the logical product of the inverted output of said third F/F circuit and the output of said second F/F circuit;

whereby when said output of said second selector changes from said read address generated by said first read address generator circuit to said read address generated by said second read address generator circuit, said second read address generator circuit is stopped by the output of said second NAND circuit from increasing the read address during the interval from a time t2 at which the digital data read by said second read address generator circuit makes zero crossing to a time t1 at which the digital data read by said first read address generator circuit makes in-phase zero crossing, in which case at said time t1 said output of said second selector changes from said read address generated by said first read address generator circuit to said read address generated by said second read address generator circuit, and when said output of said second selector changes from said read address generated by said second read address generator circuit to said read address generated by said first read address generator circuit, said first read address generator circuit is stopped by the output of said first NAND circuit from increasing the read address during the interval from a time point t3 at which the digital data read by said first read address generator circuit makes zero crossing to a time point t4 at which the digital data read from said second read address generator circuit makes in-phase zero crossing, in which case at said time point t4 said output of said second selector changes from said read address generated by said second read address generator circuit to said read address generated by said first read address generator circuit.

3. The pitch shift apparatus according to claim 2, wherein said memory is constructed in a ring memory configuration, and the read address which said first read address generator circuit generates and the read address which said second read address generator circuit generates are shifted from each other by an amount corresponding to ½ the circumference of said ring memory.

4. The pitch shift apparatus according to claim 2, wherein said memory is constructed in a ring memory configuration, and said address difference detecting circuit produces said pulse when the difference between the write address and the read address becomes an amount corresponding to $\frac{1}{4}$ the circumference of said ring memory.

* * * * *